US008276234B2

(12) United States Patent
Hsu

(10) Patent No.: US 8,276,234 B2
(45) Date of Patent: Oct. 2, 2012

(54) FOLDABLE TEXTILE HOLDER FOR A FLAT MOP

(76) Inventor: Hsing Yuan Hsu, Taichung (TW)

( * ) Notice: Subject to any disclaimer, the term of this patent is extended or adjusted under 35 U.S.C. 154(b) by 0 days.

(21) Appl. No.: 13/235,455

(22) Filed: Sep. 18, 2011

(65) Prior Publication Data

US 2012/0073074 A1 Mar. 29, 2012

(30) Foreign Application Priority Data

Sep. 25, 2010 (CN) ..... 2010 2 0542372 U

(51) Int. Cl.
*A47L 13/10* (2006.01)

(52) U.S. Cl. ..... 15/147.1; 15/228

(58) Field of Classification Search ..... 15/147.1, 15/228; *A47L 13/20, 13/24*
See application file for complete search history.

(56) References Cited

U.S. PATENT DOCUMENTS

2006/0085935 A1* 4/2006 White, II ..... 15/228
* cited by examiner

*Primary Examiner* — Monica Carter
*Assistant Examiner* — Stephanie N Berry

(57) ABSTRACT

A foldable textile holder for a flat mop includes a rectangular main board provided to be pivotally connected to a handle of the flat mop and two wing plates respectively and pivotally to two opposite ends of the main board relative to a major axis of the main board by two pivot elements. The main board and the two wing plates are situated on a same plane when cleaning the floor and form a U-shape after the two wing plates being folded, wherein each pivot element temporarily positions a corresponding one of the two wing plates when the two wing plates are upwardly folded or the main board and the two wing plates are situated on a same plane.

5 Claims, 5 Drawing Sheets

FOLDABLE TEXTILE HOLDER FOR A FLAT MOP

BACKGROUND OF THE INVENTION

1. Field of the Invention

The present invention relates to textile holder for a mop, and more particularly to a foldable textile holder for a flat mop, which can be used with a conventional water separator of a round mop.

2. Description of Related Art

A mop is good tool for cleaning floor. A conventional mop usually has a bunch of cloth strips fixed on one end of a handle thereof for scrub floor. Later, a rotary mop is marketed, which has a round textile holder that can be rotated with a water separator for flinging water from the cloth strips. The rotary mop quickly becomes a most popular cleaning tool.

However, all the conventional mops has a common disadvantage, that's, the scrub width is small in every operation. It is inconvenient for a professional janitor. As a result, a flat mop is marketed for promoting clean effect. The textile holder of the flat mop has a long major axis such that the user is hard to dry the textile after cleaning before using.

The present invention has arisen to mitigate and/or obviate the disadvantages of the conventional textile holder of a flat mop.

SUMMARY OF THE INVENTION

The main objective of the present invention is to provide an improved foldable textile holder of a flat mop, which can be used with a conventional water separator of a round mop.

To achieve the objective, the foldable textile holder in accordance with the present invention comprises a rectangular main board provided to be pivotally connected to a handle of the flat mop. The main board includes two opposite sides relative to a major axis thereof and each side has a first concavity and two grooves laterally defined therein, wherein the first concavity is situated between the two grooves. Two wing plates are respectively and pivotally to the two opposite ends of the main board relative to the major axis of the main board by two pivot elements, wherein each pivot element temporarily positions a corresponding one of the two wing plates when the two wing plates are upwardly folded or the main board and the two wing plates are situated on a same plane. Each wing plate has a second concavity laterally defined therein, wherein each second concavity communicates with a corresponding one of the two first concavities when the two wing plates and the main board are situated on the same plane. Each wing plate includes two protrusions laterally extending therefrom, wherein each protrusion is received in a corresponding one of the grooves when the two wing plates and the main board are on the same plane for promoting the connection between each wing plate and the main board.

Further benefits and advantages of the present invention will become apparent after a careful reading of the detailed description with appropriate reference to the accompanying drawings.

DETAILED DESCRIPTION OF THE INVENTION

Figure 1:
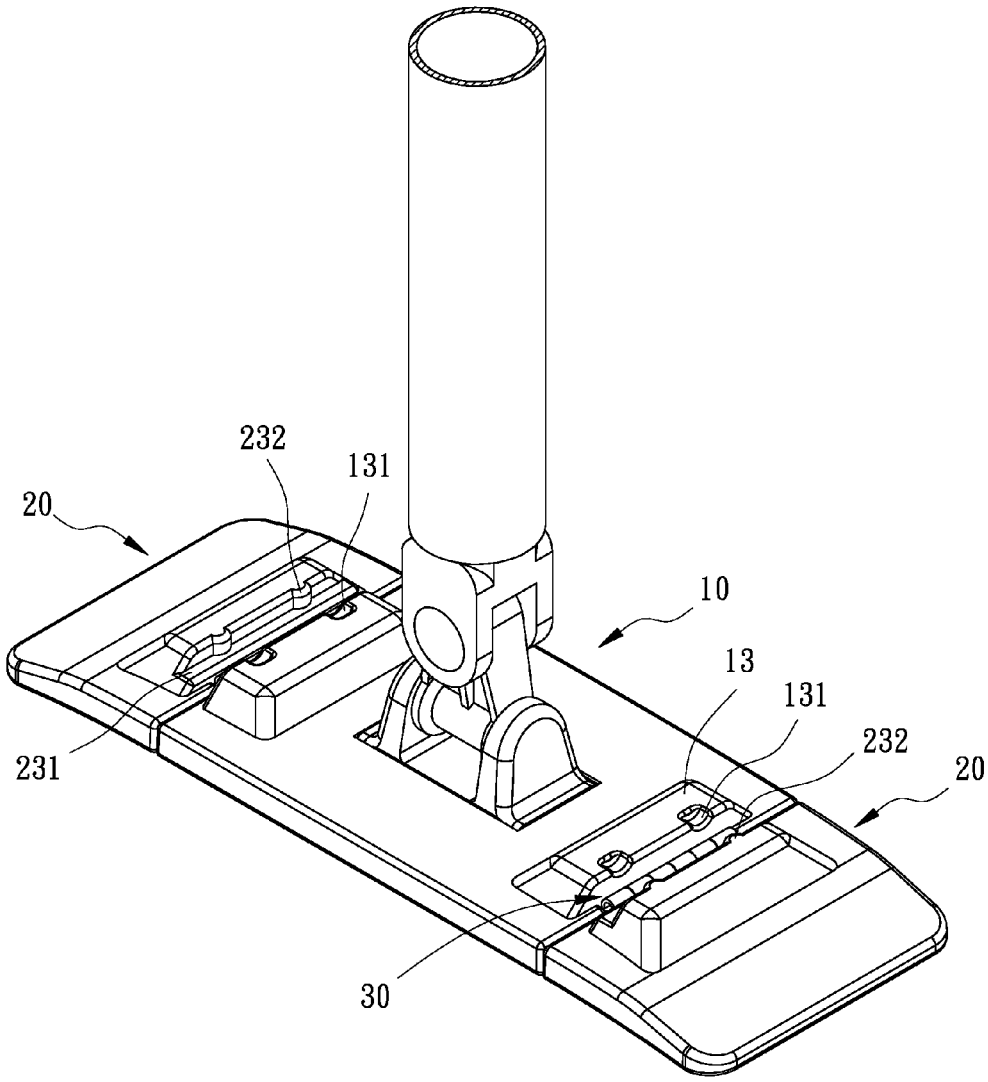
FIG. 1 is a perspective view of a foldable textile holder for a flat mop in accordance with the present invention.
Figure 2:
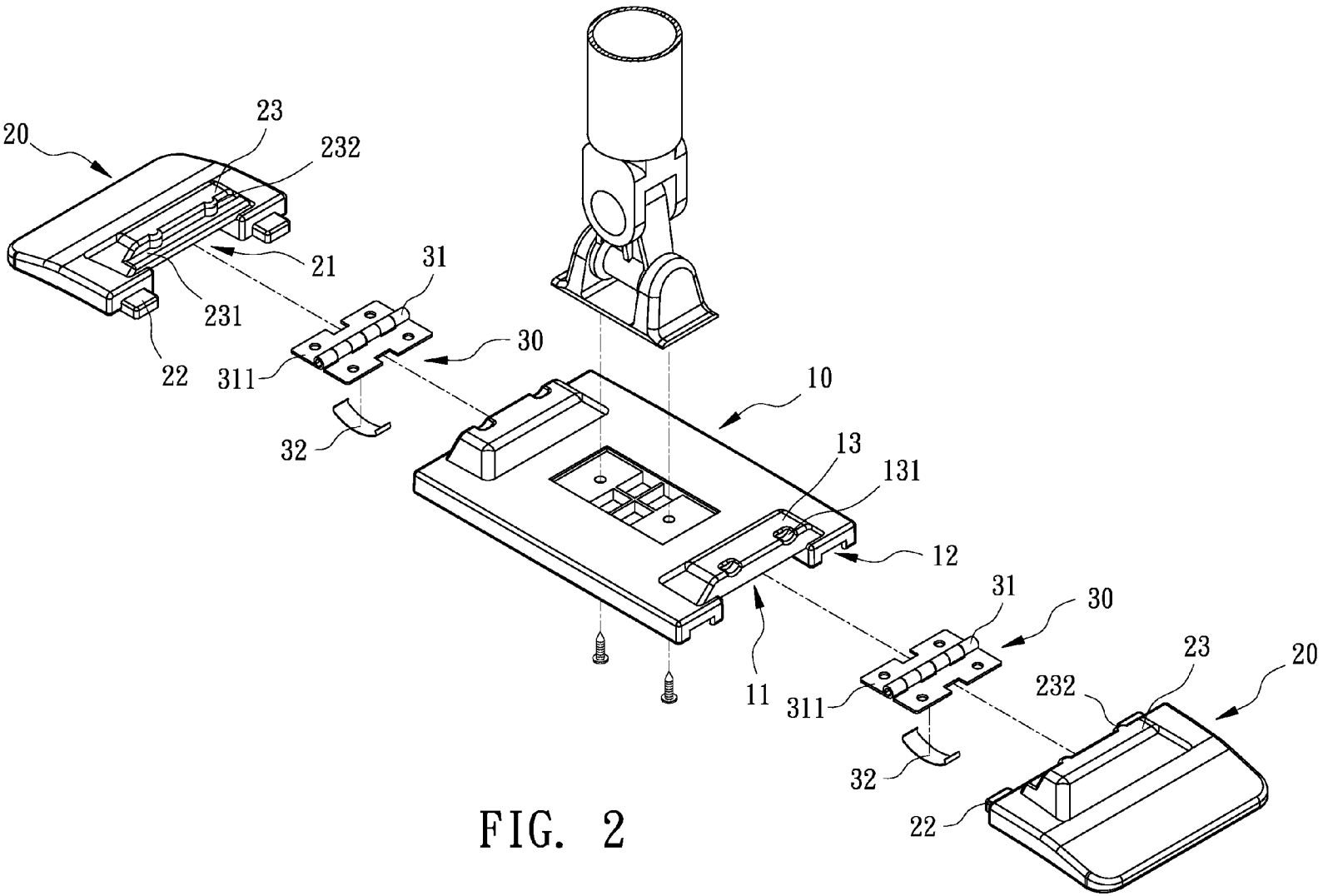
FIG. 2 is an exploded perspective view of the foldable textile holder in FIG. 1.
Figure 3:
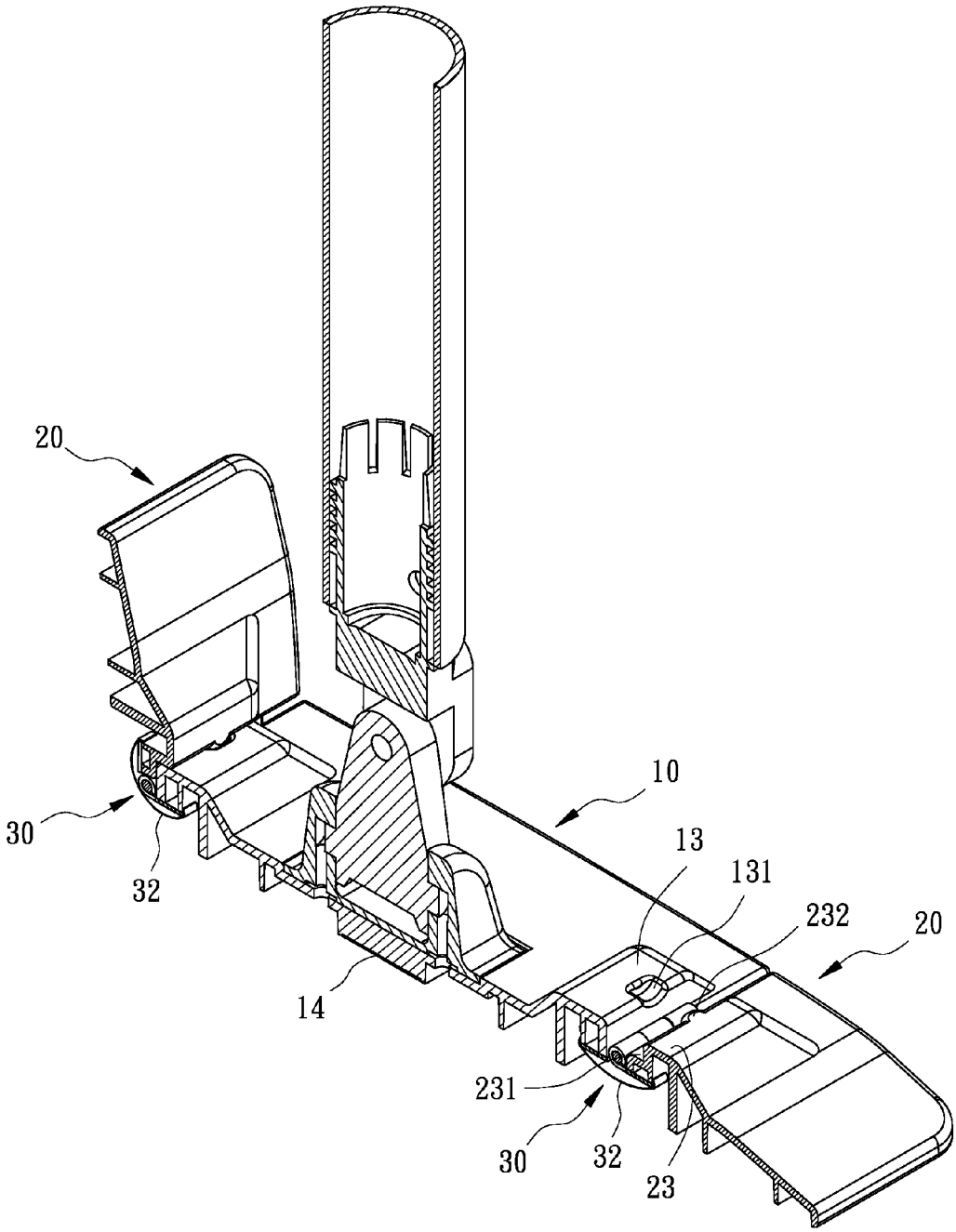
FIG. 3 is a perspective cross-sectional view of the foldable textile holder in FIG. 1.

Referring to the drawings and initially to FIGS. 1-3, a foldable textile holder for a flat mop in accordance with the present invention comprises a rectangular main board (10) adapted to be pivotally connected to a handle of the flat mop and two wing plates (20) respectively and pivotally to two opposite ends of the main board (10) relative to a major axis of the main board (10) by two pivot elements (30). The main board (10) and the two wing plates (20) are situated on a same plane when cleaning the floor and form a U-shape after the two wing plates (20) being folded, wherein each pivot element (30) temporarily positions a corresponding one of the two wing plates (20) when the two wing plates (20) are upwardly folded or the main board (10) and the two wing plates (20) are situated on a same plane. In the preferred embodiment of the present invention, the main board (10) has a width the same as that of the two wing plates (20) for easily mounting the textile (not shown).

The main board (10) includes two opposite sides relative to the major axis thereof and each side has a first concavity (11) and two grooves (12) laterally defined therein, wherein the first concavity (11) is situated between the two grooves (12). Two first raised portions (13) are upwardly formed on two opposite side of the main board (10), wherein each first raise portion (13) aligns with a corresponding one of the two first concavities (11). The first raised portion (13) has at least one indentation (131) laterally defined therein. In the preferred embodiment of the present invention, there are two indentations (131) defined in each of the two first raised portions (13). At least one adhering means (14) is secured on an underside of the main board (10) for promoting the connection between the textile and the main board (10) during scrubbing floor.

Each wing plate (20) has a second concavity (21) laterally defined therein, wherein each second concavity (21) communicates with a corresponding one of the two first concavities (11) when the two wing plates (20) and the main board (10) are situated on the same plane. Each wing plate (20) includes two protrusions (22) laterally extending therefrom, wherein each protrusion (22) is received in a corresponding one of the grooves (12) when the two wing plates (20) and the main board (10) are on the same plane for promoting the connection between each wing plate (20) and the main board (10). Each wing plate (20) has a second raised portion (23) upwardly formed thereon. Each second raised portion (23) has a recess (231) defined therein and at least one boss (232) laterally extending therefrom. In the preferred embodiment of the present invention, each second raised portions (23) has two bosses (232) extending therefrom. Each first raised portion (13) is partially received in a corresponding one of the two recesses (231) and each boss (232) is received in a corresponding one of the indentations (131) for promoting the connection between the main board (10) and the two wing plate (20) when the two wing plate (20) is upwardly folded.

The pivot element (30) has a hinge (31) and two connecting plates (311) extending from the hinge (31), wherein the two connecting plates (311) are respectively secured in the corresponded first concavity (11) and second concavity (21). A resilient plate (32) has two opposite ends respectively fixes on a distal side of each of the two connecting plates (311).

With reference to FIG. 1, the pivot elements (30) temporarily position the main board (10) and the two wing plates (20) when the main board (10) and the two wing plates (20) are situated on the same plane. Consequently, the flat mop has a widest scrub area in every operation such that the cleaning effect of floor is promoted.

Figure 4:
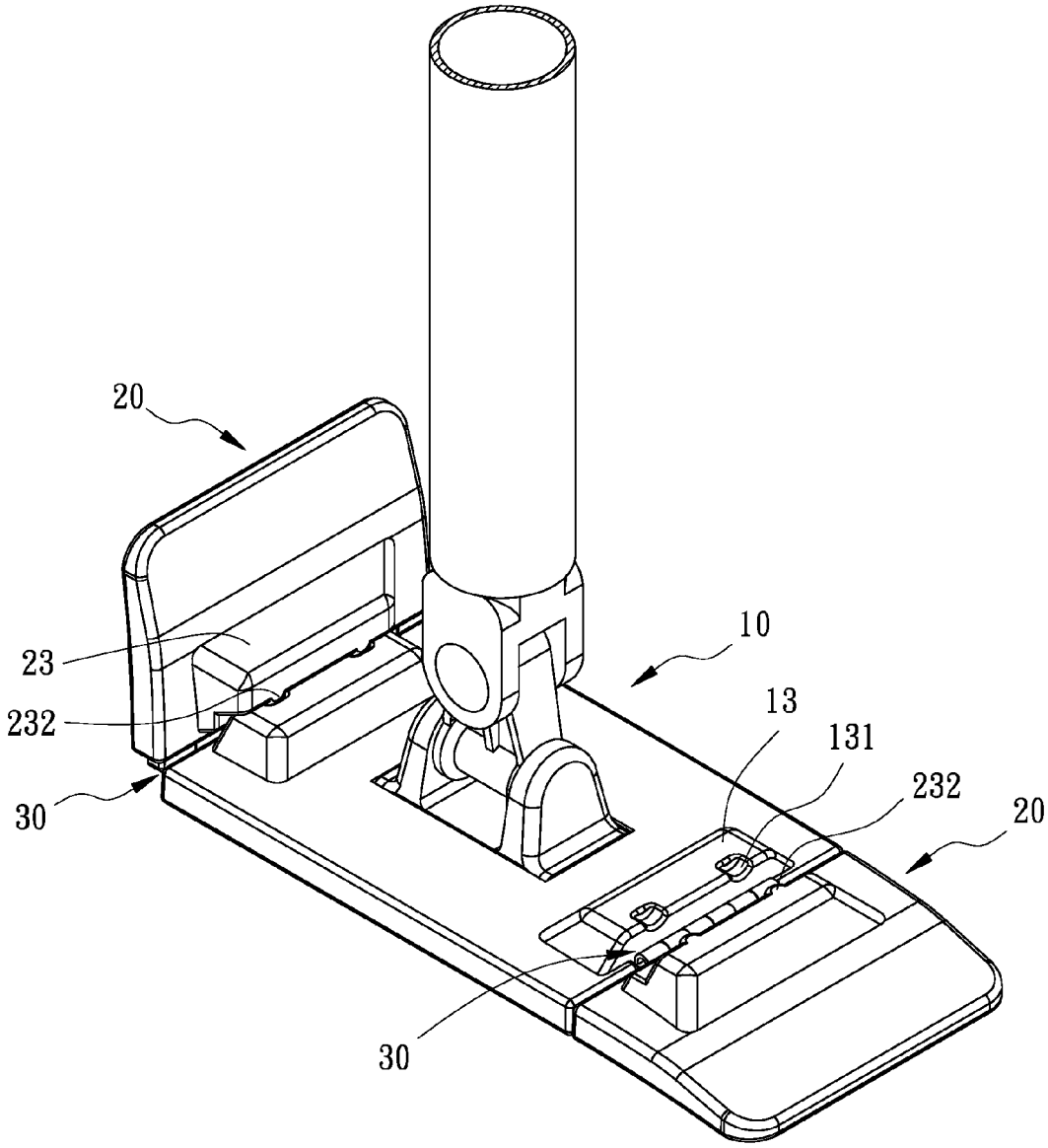
FIG. 4 is a first operational view of the foldable textile holder in accordance with the present invention.

With reference to FIG. 4, the textile holder in accordance with the present invention forms an L-shape when one of the two wing plate (20) is upwardly folded and temporarily positioned by a corresponding one of the two pivot elements (30). Consequently, the flat mop can easily and freely clean the scrubboard and the floor near the scrubboard at the same time.

Figure 5:
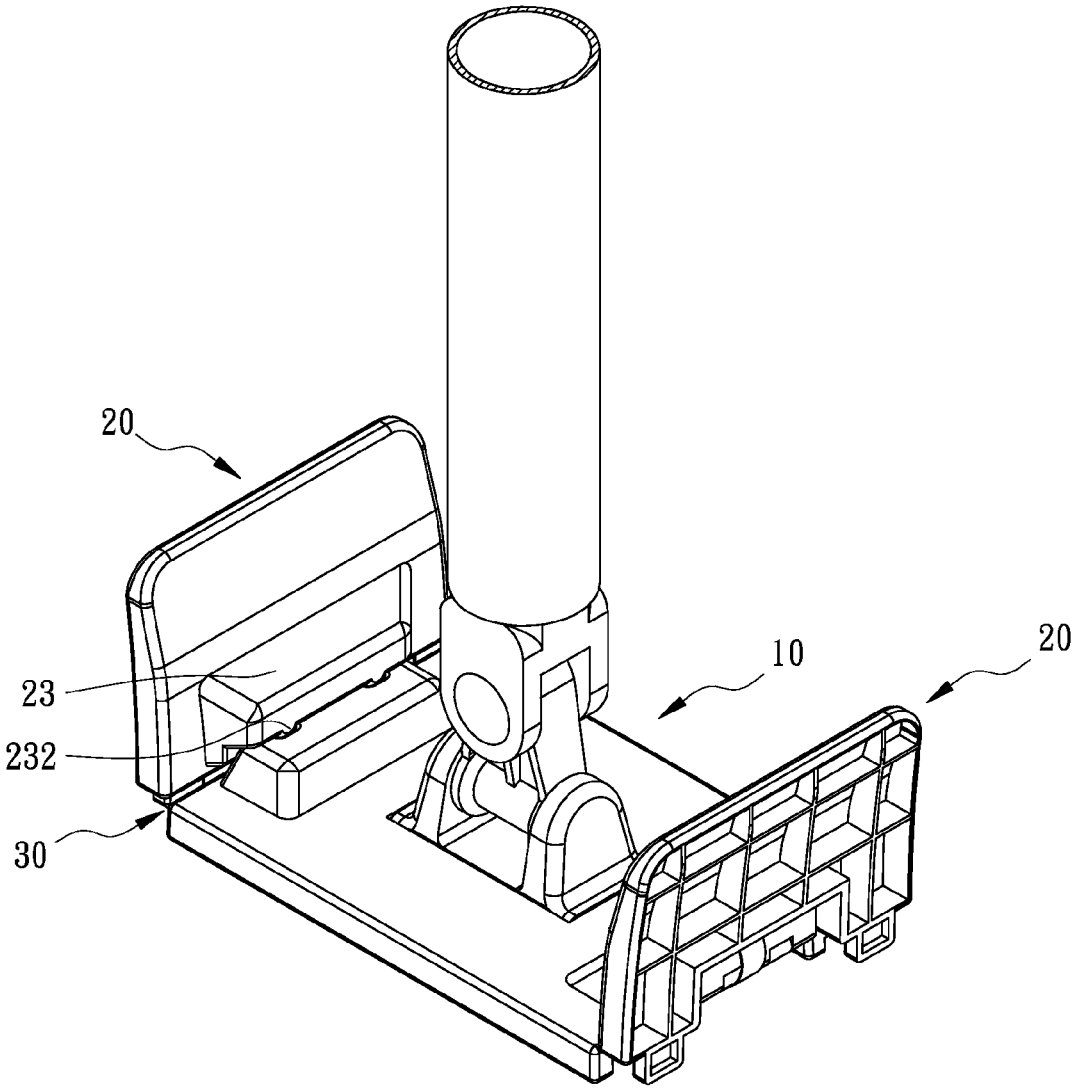
FIG. 5 is a second operational view of the foldable textile holder in accordance with the present invention.

With reference to FIG. 5, the textile holder in accordance with the present invention forms a U-shape when the two wing plate (20) are respectively upwardly folded and temporarily positioned by the two pivot elements (30). As a result, the textile can be dried by a current water separator for mop after used and cleaning Although the invention has been explained in relation to its preferred embodiment, it is to be understood that many other possible modifications and variations can be made without departing from the spirit and scope of the invention as hereinafter claimed.

What is claimed is:

1. A foldable textile holder for a flat mop, comprising:

a rectangular main board adapted to be pivotally connected to a handle of the flat mop, the main board including two opposite sides relative to a major axis thereof and each side having a first concavity and two grooves laterally defined therein, wherein the first concavity is situated between the two grooves, the main board including two first raised portions upwardly formed on two opposite sides thereof, wherein each first raised portion aligns with a corresponding one of the two first concavities, each first raised portion having at least one indentation laterally defined therein; and two wing plates respectively and pivotally to the two opposite ends of the main board relative to the major axis of the main board by two pivot elements, wherein each pivot element temporarily positions a corresponding one of the two wing plates when the two wing plates are upwardly folded or the main board and the two wing plates are situated on a same plane, each wing plate having a second concavity laterally defined therein, wherein each second concavity communicates with a corresponding one of the two first concavities when the two wing plates and the main board are situated on the same plane, each wing plate including two protrusions laterally extending therefrom, wherein each protrusion is received in a corresponding one of the grooves when the two wing plates and the main board are on the same plane for promoting the connection between each wing plate and the main board.

2. The foldable textile holder as claimed in claim 1, wherein each wing plate has a second raised portion upwardly formed thereon, each second raised portion having a recess defined therein and at least one boss laterally extending therefrom, each first raised portion partially received in a corresponding one of the two recesses and the at least one boss received in the at least one indentations for promoting the connection between the main board and the two wing plate when the two wing plate is upwardly folded.

3. The foldable textile holder as claimed in claim 1, wherein the pivot element has a hinge and two connecting plates extending from the hinge, the two connecting plates respectively secured in the corresponded first concavity and second concavity; a resilient plate having two opposite ends respectively fixes on a distal side of each of the two connecting plates.

4. The foldable textile holder as claimed in claim 1, wherein the pivot element has a hinge and two connecting plates extending from the hinge, the two connecting plates respectively secured in the corresponded first concavity and second concavity; a resilient plate having two opposite ends respectively fixes on a distal side of each of the two connecting plates.

5. The foldable textile holder as claimed in claim 2, wherein the pivot element has a hinge and two connecting plates extending from the hinge, the two connecting plates respectively secured in the corresponded first concavity and second concavity; a resilient plate having two opposite ends respectively fixes on a distal side of each of the two connecting plates.

* * * * *